US005271198A

United States Patent [19]

Freeman

[11] Patent Number: 5,271,198

[45] Date of Patent: Dec. 21, 1993

[54] ATTIC STAIR INSULATION DOME FORMER

[76] Inventor: Thomas F. Freeman, 88 Linnet St., Bayonne, N.J. 07002

[21] Appl. No.: 848,364

[22] Filed: Mar. 9, 1992

[51] Int. Cl.[5] ..... E06B 3/26

[52] U.S. Cl. ..... 52/202; 52/186; 182/46

[58] Field of Search ..... 52/202, 19, 186, 309.9, 52/405, 406; 182/46, 77, 81, 88; 220/507, 421, 520, 522, 524

[56] References Cited

U.S. PATENT DOCUMENTS

| | | | |
|---|---|---|---|
| 4,281,743 | 8/1981 | Fuller | 182/81 |
| 4,312,423 | 1/1982 | Helbig | 182/81 |
| 4,337,602 | 7/1982 | King | 52/202 |
| 4,344,505 | 8/1982 | Waters et al. | 182/77 |
| 4,658,555 | 4/1987 | Steiner | 52/202 |
| 4,832,153 | 5/1989 | Daw et al. | 52/186 |
| 4,928,441 | 5/1990 | Daley | 52/202 |

*Primary Examiner*—Carl D. Friedman
*Assistant Examiner*—Kien Nguyen

[57] ABSTRACT

An insulation-dome former adapted for receiving and retaining available thermal insulation materials within, and weather strip-type gasketing on the exterior surfaces of same for the purpose of use above a folding stair-type hatch opening where a common-type heat loss condition usually exists. A moisture barrier insert is used when moisture resistant materials for the dome former are not employed.

7 Claims, 9 Drawing Sheets

ATTIC STAIR INSULATION DOME FORMER

BACKGROUND OF THE INVENTION

The invention relates generally to insulation devices for common-type folding stair hatch openings.

STATEMENT OF PRIOR ART

The prior art, as exemplified in U.S. Pat. Nos. 4,572,865; 4,658,555; and 4,151,894, is generally illustrative of insulation devices currently used and available for folding stair hatch openings.

The problem with these prior art examples is that, depending upon their respective sizes and configurations, they are either inadequate in insulation effectiveness due to limited R-Value potential, or difficult to handle during transport to an installation site.

The invention herein described combines ease in transport and handling before installation while its potential insulation effectiveness or R-Value may be regulated by the user and allows same to insulate a hatch opening according to, if need dictates, individual unique specifications.

SUMMARY OF THE INVENTION

The invention herewith described configures essentially of a folding stairway hatch-type, portable erectile, compartmentalized, insulation-dome forming device with an insertable-type moisture barrier, neither of which, in and of itself, effects as an insulation material.

The preferred embodiment of the device comprises common-type portably erectile from collapsible fiberboard, or alternately, plastic boxes, thus making it dimensional from a reduced compact, durable, easily transported commodity. The alternative use of plastic, rather than fiberboard boxes negates the need for said moisture barrier.

The device allows the user to control adaptation of one or several of the numerous and varied types of weather stripping or insulation materials which possess varying textures, densities, popularity, and R-Values, widely available in the marketplace and household, by installing same within, as with insulation material, or upon, as with weather-strip gasketing, the several joined compartments which this invention sustains.

DETAILED DESCRIPTION OF THE INVENTION

A folding stair hatch opening-type insulation-dome forming device particularly adapted to receive and retain thermal insulation material and weather strip-type gasketing and is portably erectile with collapsing features adapted to allow for easy transport and handling before installation.

The dome shaped insulation former will herein after be referred to as "dome".

Figure 1:
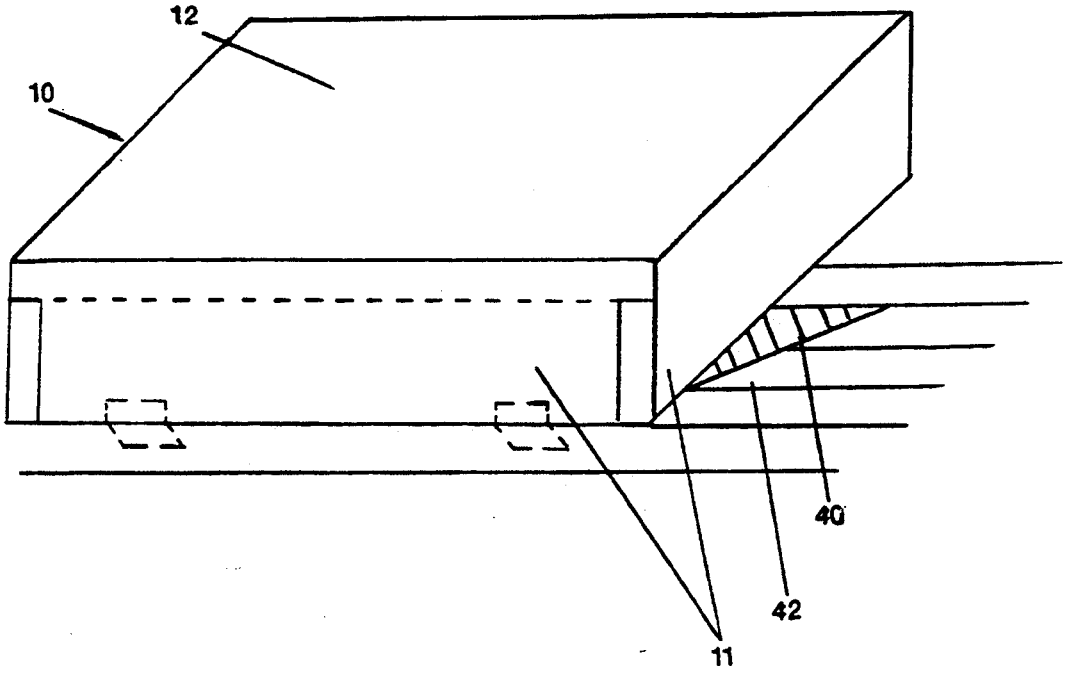
FIG. 1 is a perspective top view of the dome's preferred embodiment as it opens over a common-type hatchway against a surrounding floor plane.

A dome, 10 of FIG. 1, has lateral compartments, 11, and a top compartment, 12, which are attached to each other with glue, staples, or other fastening implement(s).

Figure 4:
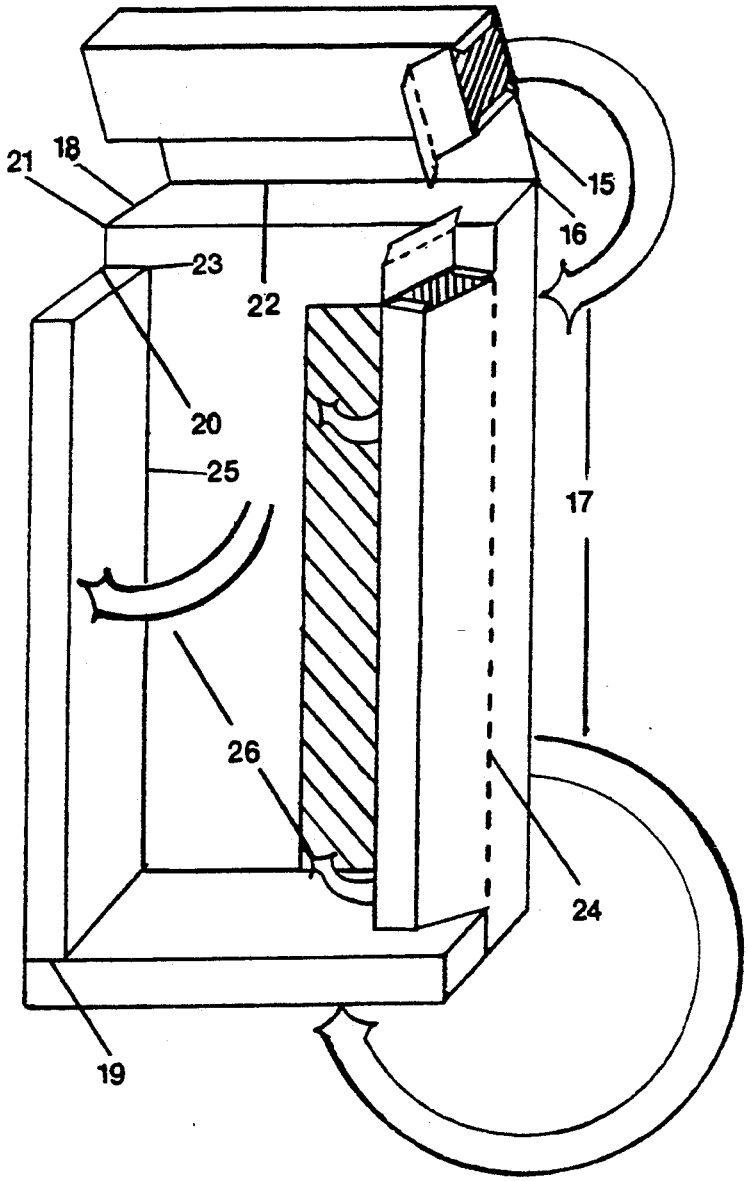
FIG. 4 is a perspective bottom view of a preferred embodiment depicting the two patterns by which the lateral compartments may be joined and operated towards full assembly and disassembly with the top compartment.

An attachment-pattern of a lateral compartment, 11, to the top compartment, 12, places a flat "wing" panel, 15 of FIG. 4, laterally and parallely along the longest length of the outermost plane of said lateral compartment, 11, and extending perpendicularly therefrom to the outermost angle, 16, of the top compartment, 12, and being pivotally attached thereto and functionally operative, 17 of FIG. 4, per the axis, 22, thereof; said perpendicular extension of wing panel, 15, being equal in length to the shortest width of the outermost plane, 18, of the top compartment, 12.

A second alternative attachment pattern of a lateral compartment, 11, to the top compartment, 12, places the uppermost plane of said lateral compartment, 11, parallel and entirely attached to the outermost portion of the lowermost plane, 19 of FIG. 4, of the top compartment, 12, and having the vertex of the outer and uppermost angle, 20 of FIG. 4, of said lateral compartment, 11, colinear with the vertex, 21, of the outer and lowermost angle of said top compartment, 12, said lateral compartment's outer vertex, 20, serving as a hinge axis device, 24, in complimentary concord with the lateral compartment's upper and innermost vertex, 23, and sharing a parallel axis, 25, in operation, 26, therewith.

Figure 5:
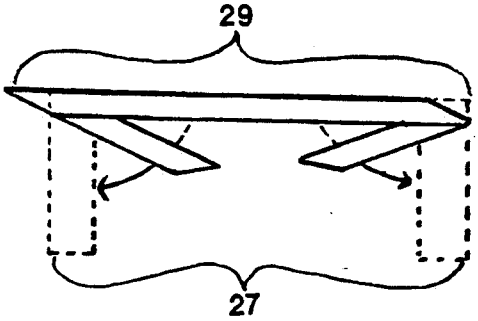
FIG. 5 is a two dimensional cutaway view of one of the preferred embodiment patterns of collapsing the top and lateral compartments.
Figure 6:
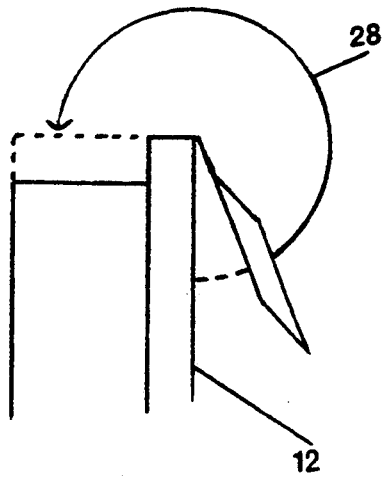
FIG. 6 is a fragmentary two dimensional view of the preferred embodiment's second pattern of collapse of a lateral compartment in relation to a top compartment.

The lateral compartment, 11, has two (2) alternative collapsed-to-portably erectile patterns, 27 of FIG. 5, and 28 of FIG. 6, whereby all respective inner and outer lateral compartment planes which meet one another in forming their generally flat configuration are converted to their fully dimensioned, functionally potent form.

The top compartment, 12, has a portably erectile-collapsing pattern, 29 of FIG. 5, whereby the upper and lowermost planes thereof meet one another in forming their generally flat configuration and therefrom convertable to their fully dimensional, functionally potent form.

Figure 9:
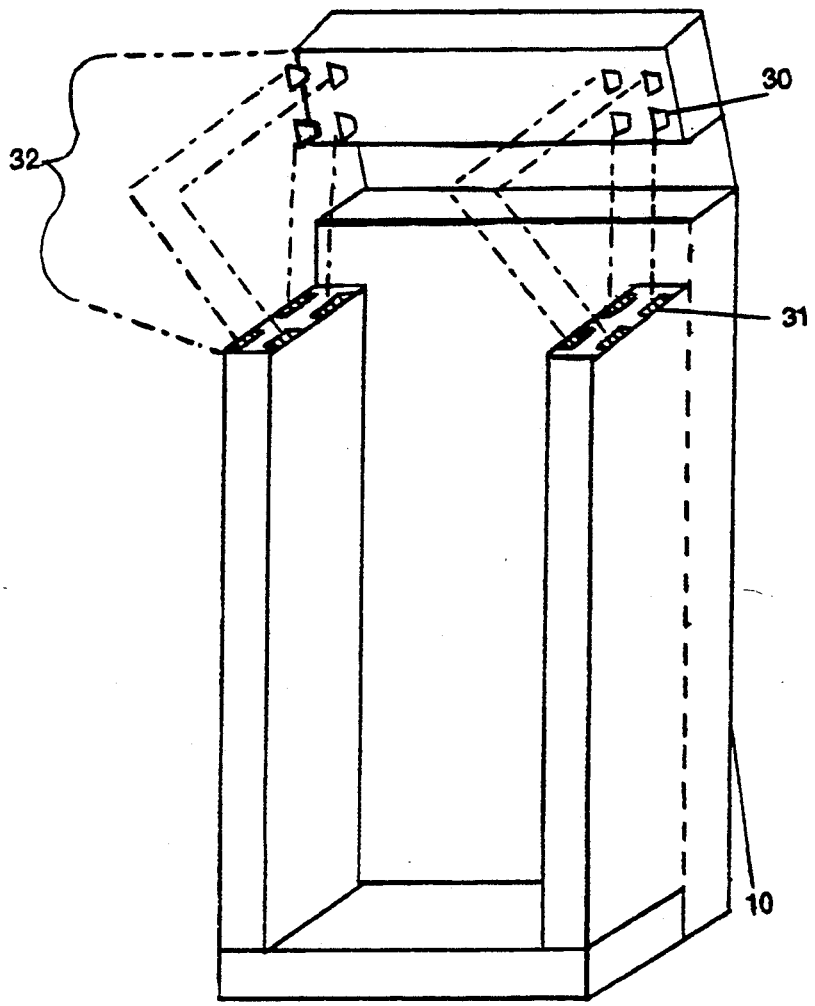
FIG. 9 is a perspective bottom view of a preferred embodiment where one alternative of subject device's locations and erectile patterns for a tab and slot system of joining the subject invention's four lateral compartments to each other is noted.

The dome, 10, having four (4) lateral compartments, 11, which meet each other along a common plane to form a quadrilateral interior and exterior side wall effect for said dome, 10, utilizes a tab, 30, and slot, 31, system and pattern, 32 of FIG. 9, of joining said lateral compartments to form angles perpendicular to the lowermost plane of the top compartment, 12; said slots, 31, are die cut into fiberboard or plastic box blanks during manufacture while said tabs, 30, are hingedly attached with glue or staples or are also die cut into the inside lateral plane of the lateral compartment, 11.

Figure 7:
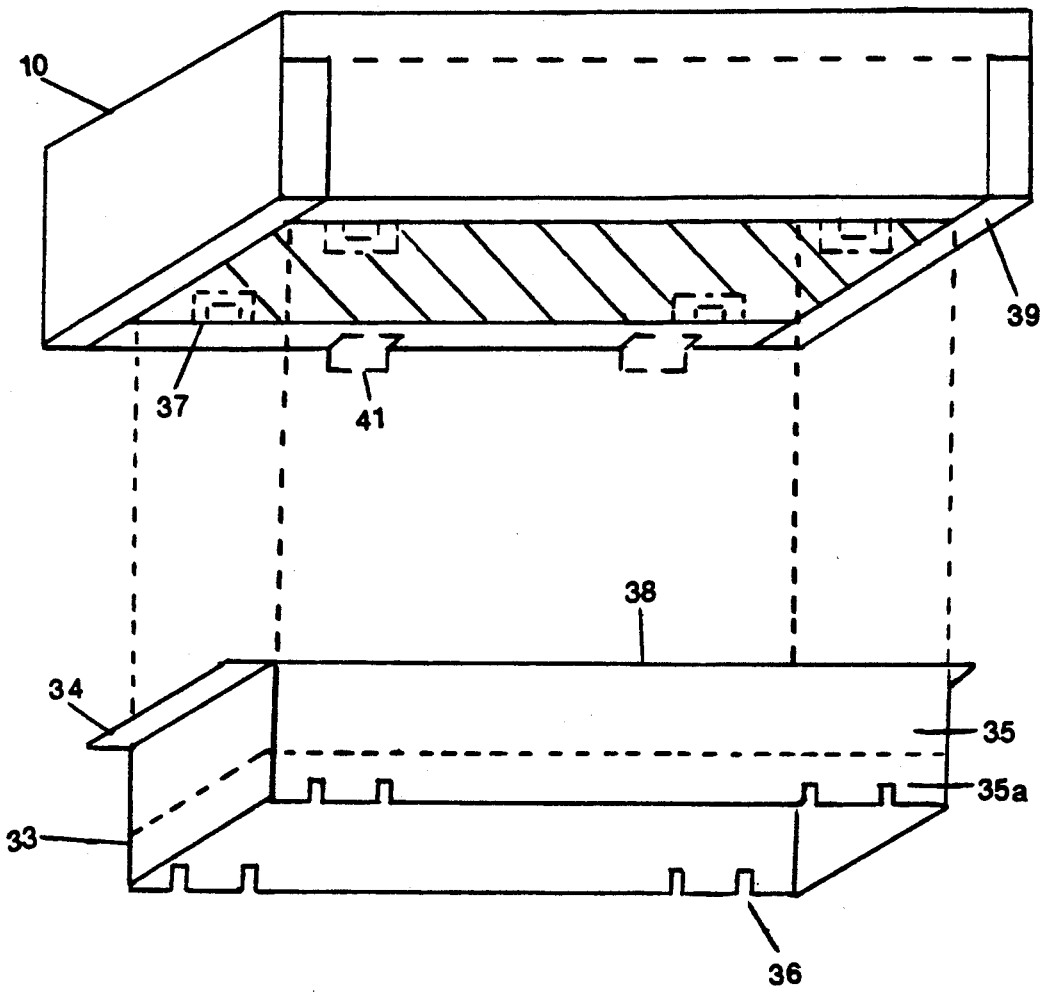
FIG. 7 is a perspective bottom view of the dome and mating moisture barrier insert.

The dome, 10, may be fitted with handles, 37 of FIG. 7, preferably of the plastic strap or rope variety, and secured with rivets, staples, or other fastening device, to the inside lateral planes of the lateral compartments, 11.

Figure 8:
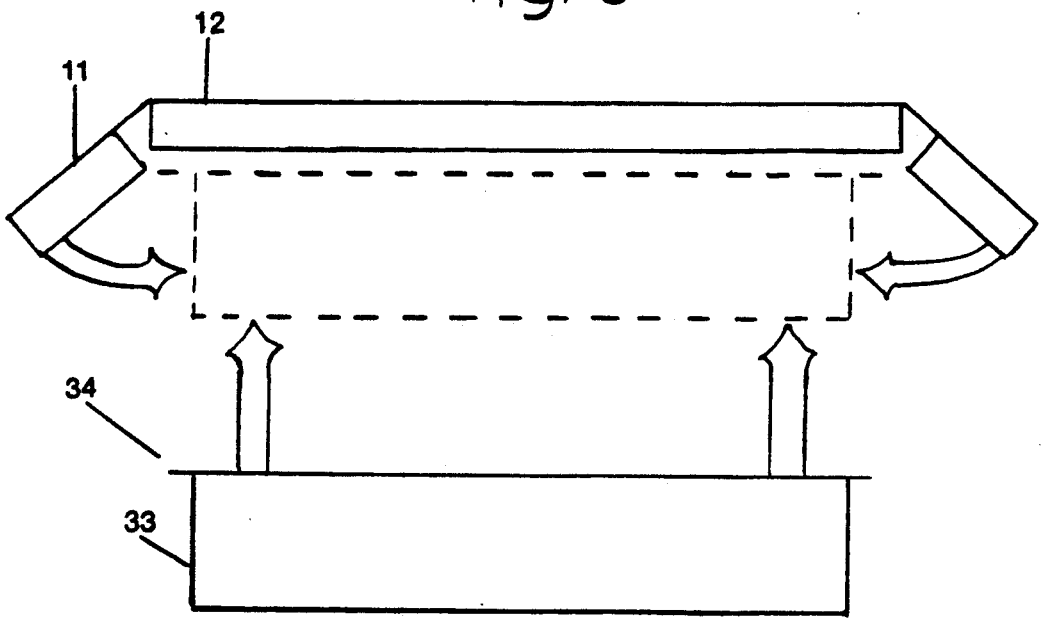
FIG. 8 is a cross-section cutaway view of the top compartment, two preferred embodiment lateral compartments, and the preferred embodiment's mating foil-lined insert's assembly pattern noted with "phantom lines".

The dome, 10, may be fitted with a foil or other type moisture barrier insert, 33 of FIG. 7, as it appears in the preferred embodiment, and preferably will comprise a foil or other material-lined box which is of the common collapsible paperboard variety with an additional pair of "top planar extension flaps", 34, which are positioned on at least two (2) opposite ends of the uppermost plane of said insert, 33, and poised for assembly therewith against and parallel to the lowermost plane of the top compartment, 12, and the uppermost plane of the lateral compartment, 11 of FIG. 8; said insert, 33, also being attached at the lower perimeter, 35*a*, of lateral panels, 35, utilizing notches, 36, which fit about handles, 37.

An alternative method of attachment of said insert, 33 of FIG. 7, to dome, 10, is with the use of common peel-off tape-type adhesive located, at manufacture, to the perimeter, 35*a*, of the lateral panels, 35, of said insert, 33, and upon the uppermost plane, 38, of said insert, 33.

Figure 2:
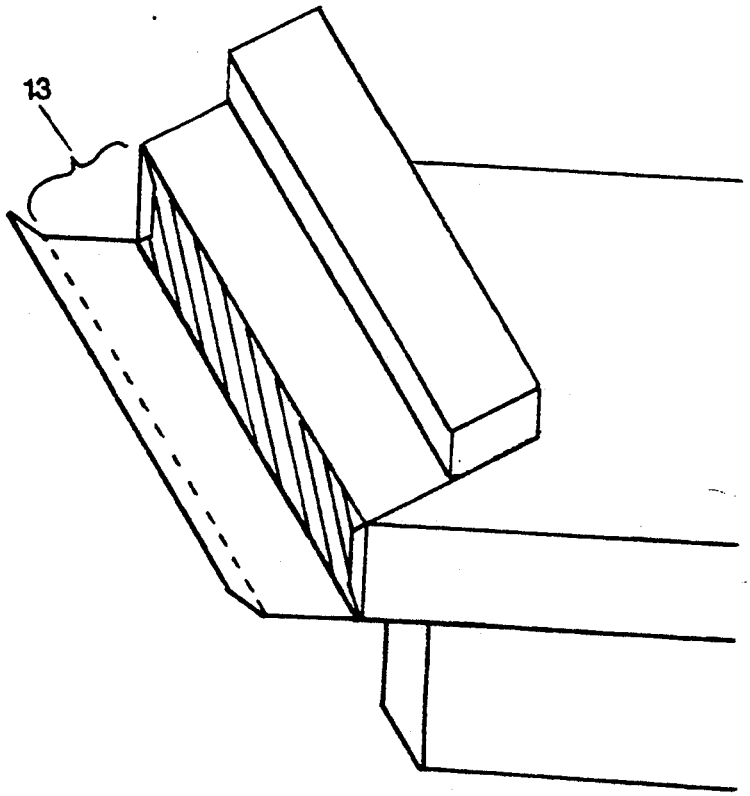
FIG. 2 is a perspective view of a preferred embodiment closure device for all compartments.

The dome, 10, having compartments, each being adapted to receive insulation material utilizes a common-type fiberboard or plastic box closure device, 13 of FIG. 2, on at least one (1) plane of each compartment, lateral, 11, or top, 12, to retain whatever insulation material is inserted.

Figure 3:
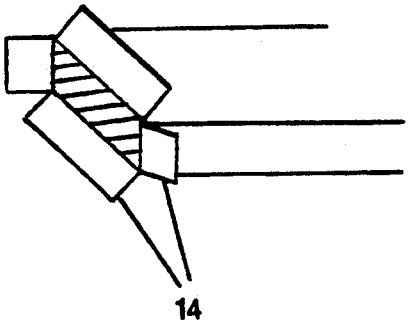
FIG. 3 is a perspective view of an alternative type of closure for compartment planes.

An alternative compartment closure device, 14 of FIG. 3, utilizes the common-type four (4) flap variety in conjunction with ordinary high strength packing tape to retain the contents of each respective compartment.

Common-type high strength packing tape, preferably of the 2 inch width size, is also used to reinforce all seams between all respective compartments.

The dome, 10, may be gasketed with a weather stripping or the user's choice, suggestively of the common stick-on variety, by placing same around the inside perimeter of the lowermost plane of all lateral compartments, 11, of the fully assembled dome, 10.

The dome, 10, may be centered and set in an inverted position to cover a hatch opening, 40 of FIG. 1, and optionally secured with hinges, preferably of the plastic variety, 41 of FIG. 7, to the surrounding floor plane, 42 of FIG. 1.

The foregoing description of preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A formative insulating dome for use over an opening which accommodates a stored folded stairway with and above an attic floor surface; said dome comprising:

a) a top compartment having a top surface and a bottom surface and a plurality of sides; and, b) a plurality of lateral compartments comprising three-dimensional configurations with surfaces both abutting and non-abutting to said bottom surface and said sides; said lateral compartments each extending beneath said bottom surfaces along said sides; said lateral compartments being joined to said top compartments by a hinge and/or fastening means; said lateral compartments being joined to each other in an erected configuration, in an abutting manner as to form a perimeter wall configuration; said lateral compartments being joined to each other per a fastening means; said perimeter wall configuration being inclusive of: a) an inner-most surface which is perpendicular to said bottom surface and non-abutting to said sides; and, b) a lower-most planar surface which is parallel to said top surface of said top compartment.

2. A formative dome of claim 1 wherein said dome being movable from a collapsed configuration to the erected configuration; said top and lateral compartments being formed of hingedly connected sections of planar material; said connected sections being movable from a relatively planar collapsed configuration to tubular configurations capable of receiving insulation, whereby said dome may be shipped in a flat, collapsed configuration.

3. A formative dome of claim 2, wherein each of said tubular configurations include a closure panel adapted to close said tubular configuration to form closed compartments.

4. A formative dome of claim 3, wherein thermal insulation material is provided within each of said closed compartments.

5. A formative dome of claim 2, wherein said folded stairway is situated with its upper-most edge located above said attic floor surface; said dome being positioned as with:

a) said perimeter wall configuration surrounding said stored stairway, b) said lower-most planar surface directly above said attic floor surface, surrounding said opening, and, c) said top compartment centered directly above said folded stairway.

6. A formative dome of claim 2, wherein a gasket is provided along said lower-most planar surface of said perimeter wall configuration; said gasket comprising material of sufficient capacity as to create an insulative seal within the gap abutting said lower-most planar surface and said attic floor surface; said gasket being attached to said lower-most planar surface by a fastening means.

7. A formative dome of claim 2, wherein a moisture shield is provided upon said inner-most surface of said perimeter wall configuration, and upon said bottom surface of said top compartment; said moisture shield comprising material of sufficient composition as to prevent evaporated moisture penetration.

* * * * *